US011772852B2

(12) United States Patent
Yonkers et al.

(10) Patent No.: US 11,772,852 B2
(45) Date of Patent: Oct. 3, 2023

(54) VENTING CLOSURE LINER

(71) Applicant: Silgan White Cap LLC, Downers Grove, IL (US)

(72) Inventors: David Richard Yonkers, Aurora, IL (US); Darren Neputy, Palos Hills, IL (US)

(73) Assignee: Silgan White Cap LLC, Downers Grove, IL (US)

( * ) Notice: Subject to any disclaimer, the term of this patent is extended or adjusted under 35 U.S.C. 154(b) by 0 days.

(21) Appl. No.: 17/573,063

(22) Filed: Jan. 11, 2022

(65) Prior Publication Data

US 2022/0194668 A1 Jun. 23, 2022

Related U.S. Application Data

(63) Continuation of application No. PCT/US2021/064369, filed on Dec. 20, 2021.

(60) Provisional application No. 63/129,015, filed on Dec. 22, 2020.

(51) Int. Cl.

| | |
|---|---|
| ***B65D 41/34*** | (2006.01) |
| ***B65D 51/16*** | (2006.01) |
| ***B65D 41/32*** | (2006.01) |

(52) U.S. Cl.

CPC ..... *B65D 41/3428* (2013.01); *B65D 41/325* (2013.01); *B65D 51/1661* (2013.01)

(58) Field of Classification Search

CPC .. B65D 41/325; B65D 41/32; B65D 41/3428; B65D 51/1661; B65D 51/1633; B65D 51/1611; B65D 51/1605; B65D 51/16

USPC ..... 215/344, 343, 341, 316, 253, 252, 250, 215/310, 307; 220/266, 265, 366.1, 374, 220/373, 367.1

See application file for complete search history.

(56) References Cited

U.S. PATENT DOCUMENTS

| | | | | |
|---|---|---|---|---|
| D57,050 | S | 2/1921 | Ingram | |
| D57,054 | S | 2/1921 | Ingram | |
| 1,495,324 | A | 5/1924 | Hammer | |
| D73,696 | S | 10/1927 | Green | |
| 1,667,003 | A | 4/1928 | Hardiman | |
| 3,010,596 | A * | 11/1961 | Williams | B65D 51/1661 215/307 |
| D196,082 | S | 8/1963 | Stull | |
| 3,246,784 | A * | 4/1966 | Scharf | B65D 41/42 215/254 |

(Continued)

FOREIGN PATENT DOCUMENTS

| | | |
|---|---|---|
| JP | 09-328157 | 12/1997 |
| JP | 2003-024234 | 1/2003 |

(Continued)

OTHER PUBLICATIONS

Translation of JPH0938157, Masahiro, Dec. 22, 1997, Paragraphs 17-18. (Year: 1997).*

(Continued)

*Primary Examiner* — Robert J Hicks

(74) *Attorney, Agent, or Firm* — Reinhart Boerner Van Deuren s.c.

(57) ABSTRACT

A closure having a liner is provided. The liner forms one or more venting recesses that facilitate relieving pressure from a container to which the closure is affixed. In embodiments the liner extends from an outer surface of an annular wall through an outer disc of the liner.

20 Claims, 5 Drawing Sheets

(56) References Cited

U.S. PATENT DOCUMENTS

| | | | | |
|---|---|---|---|---|
| 3,812,994 | A | 5/1974 | Feldman | |
| 3,966,071 | A * | 6/1976 | Northup | B65D 41/348 215/307 |
| 4,256,234 | A * | 3/1981 | Mori | B65D 53/04 524/232 |
| 4,747,502 | A * | 5/1988 | Luenser | B65D 41/045 220/366.1 |
| 4,981,230 | A | 1/1991 | Marshall et al. | |
| 5,062,538 | A * | 11/1991 | Ochs | B65D 51/145 215/276 |
| 5,265,747 | A * | 11/1993 | Gregory | B65D 51/1688 215/349 |
| 5,385,252 | A | 1/1995 | Hidding et al. | |
| D359,682 | S | 6/1995 | Miller | |
| 5,487,481 | A | 1/1996 | Sander et al. | |
| 5,673,809 | A | 10/1997 | Ohmi et al. | |
| 5,743,420 | A | 4/1998 | Loffler et al. | |
| 5,803,286 | A | 9/1998 | Pfefferkom et al. | |
| 5,913,437 | A | 6/1999 | Ma | |
| D443,513 | S | 6/2001 | Goettner | |
| D451,393 | S | 12/2001 | Gerhart et al. | |
| 6,405,886 | B1 | 6/2002 | Gearhart et al. | |
| D460,357 | S | 7/2002 | Kras et al. | |
| D465,731 | S | 11/2002 | Brant et al. | |
| 6,491,176 | B1 | 12/2002 | Schollenberger et al. | |
| 6,581,793 | B1 | 6/2003 | Racine et al. | |
| D481,314 | S | 10/2003 | Noonan | |
| 6,677,397 | B1 | 1/2004 | Baranowski et al. | |
| 6,766,916 | B2 | 7/2004 | Ma | |
| 6,783,015 | B1 | 8/2004 | Bosl et al. | |
| 6,964,346 | B1 | 11/2005 | Taber et al. | |
| 6,981,602 | B2 | 1/2006 | Ma et al. | |
| D515,429 | S | 2/2006 | Pace | |
| 518,717 | A1 | 4/2006 | German | |
| D529,804 | S | 10/2006 | Lohrman | |
| D534,802 | S | 1/2007 | German | |
| 7,306,108 | B2 | 12/2007 | Cleevely | |
| 7,314,146 | B2 | 1/2008 | Mavin | |
| D574,240 | S | 8/2008 | Szczesniak | |
| 7,413,097 | B1 | 8/2008 | Adams | |
| D578,889 | S | 10/2008 | Sadiq | |
| D583,237 | S | 12/2008 | Fuchs | |
| D606,401 | S | 12/2009 | Kamath et al. | |
| D606,864 | S | 12/2009 | Robinson | |
| D632,958 | S | 2/2011 | Fuchs | |
| D634,200 | S | 3/2011 | Taber et al. | |
| 8,066,133 | B2 | 11/2011 | Takamatsu et al. | |
| D687,299 | S | 8/2013 | Peykoff et al. | |
| D688,128 | S | 8/2013 | Krause | |
| D693,685 | S | 11/2013 | Ramsey et al. | |
| D723,370 | S | 3/2015 | Medlin | |
| D723,919 | S | 3/2015 | Taber et al. | |
| D731,238 | S | 6/2015 | Kalaouze, Jr. | |
| D762,115 | S | 7/2016 | Corvaglia et al. | |
| D789,201 | S | 6/2017 | Yu | |
| D792,219 | S | 7/2017 | Bueno Nunez | |
| D824,257 | S | 7/2018 | Wood | |
| D836,442 | S | 12/2018 | Wood et al. | |
| D838,171 | S | 1/2019 | Wood et al. | |
| D863,963 | S | 10/2019 | Garcia | |
| 2001/0027957 | A1 | 10/2001 | Kano | |
| 2002/0158037 | A1 | 10/2002 | Kano et al. | |
| 2003/0132244 | A1 | 7/2003 | Birkmayer et al. | |
| 2007/0051690 | A1 | 3/2007 | Hidding | |
| 2008/0067142 | A1 | 3/2008 | Druitt | |
| 2008/0087625 | A1 | 4/2008 | Kumata | |
| 2008/0173611 | A1 | 7/2008 | Neputy | |
| 2009/0008392 | A1 | 1/2009 | De Cleir | |
| 2011/0024423 | A1 | 2/2011 | Erspamer et al. | |
| 2012/0031871 | A1 | 2/2012 | Molinaro et al. | |
| 2013/0056436 | A1 * | 3/2013 | Muto | B65D 53/04 215/307 |
| 2013/0205718 | A1 | 8/2013 | Kapolas | |
| 2013/0313218 | A1 | 11/2013 | Cox et al. | |
| 2014/0158660 | A1 | 6/2014 | Wood et al. | |
| 2014/0263335 | A1 | 9/2014 | Taber et al. | |
| 2016/0332783 | A1 | 11/2016 | Kim | |
| 2017/0021978 | A1 | 1/2017 | Keener | |
| 2017/0050350 | A1 | 2/2017 | Falzoni et al. | |
| 2018/0044079 | A1 | 2/2018 | Van de Grift et al. | |
| 2018/0057227 | A1 | 3/2018 | Bartow | |
| 2018/0079552 | A1 | 3/2018 | Ayeni | |
| 2018/0162605 | A1 | 6/2018 | Zeng et al. | |
| 2018/0370701 | A1 | 12/2018 | Maguire | |
| 2019/0009953 | A1 | 1/2019 | Edie et al. | |
| 2019/0016510 | A1 | 1/2019 | Woodley | |
| 2019/0062007 | A1 | 2/2019 | Kim | |
| 2019/0118989 | A1 | 4/2019 | Kim | |
| 2019/0337691 | A1 | 11/2019 | Kim | |
| 2019/0337692 | A1 | 11/2019 | Kim | |
| 2019/0344933 | A1 | 11/2019 | Kim | |

FOREIGN PATENT DOCUMENTS

| | | | | |
|---|---|---|---|---|
| JP | 2006-206188 | | 8/2006 | |
| KR | 10-2007-0052735 | | 5/2007 | |
| WO | WO-9721602 | A2 * | 6/1997 | B65D 41/0471 |
| WO | WO2011/085164 | | 7/2011 | |
| WO | WO 2013/077099 | | 5/2013 | |

OTHER PUBLICATIONS

"38 MM Lead Bore Seal," Jul. 22, 2017, accessed on Internet on Aug. 2, 2019 [http://plastics.silgan-closures.com/eu_en/product/311], 1 page.

"38 MM Lead Overcap," Jul. 22, 2017, accessed on Internet on Aug. 2, 2019 [http://plastics.silgan-closures.com/eu_en/product/313], 1 page.

Turbosquid, "Plastics Bottle Screw Cap," Apr. 28, 2014, accessed on Internet Dec. 5, 2019, [https://www.turbosquid.com/FullPreview/Index.cfm/ID/817447], 1 page.

Silgan Closures, "38MM 3 Lead Wadded," Aug. 6, 2017, accessed on Internet Dec. 5, 2019, [http://plastics.silgan-closures.com/eu_en/product/310], 1 page.

International Search Report and Written Opinion for International Application No. PCT/US2021/064369, dated Apr. 27, 2022, 11 pages.

* cited by examiner

VENTING CLOSURE LINER

CROSS-REFERENCE TO RELATED PATENT APPLICATIONS

The present application is a continuation of International Application No. PCT/US2021/064369, filed Dec. 20, 2021, which claims the benefit of and priority to U.S. Provisional Application No. 63/129,015, filed on Dec. 22, 2020, each of which is incorporated herein by reference in its entirety.

BACKGROUND OF THE INVENTION

The present invention relates generally to a closure having a plug seal configuration that allows the closure to interchangeably be fluidly sealed to container neck finishes while providing pressure-relieving recesses.

SUMMARY OF THE INVENTION

One embodiment of the invention relates to a closure including a top panel including a lower surface, a rotational axis about which the top panel is centered, a cylindrical wall extending from the lower surface of the top panel to a bottom edge of the cylindrical wall, a thread formed about an inner surface of the cylindrical wall, and a liner coupled to the lower surface of the top panel. The liner includes a cylindrical portion extending away from the top panel. The cylindrical portion includes an outer surface facing away from the rotational axis. The outer surface includes a recess and an outer-most surface. The recess extends a first distance from the rotational axis and the outer-most surface extends a second distance from the rotational axis greater than the first distance.

In a specific embodiment, the outer surface of the cylindrical portion is configured to interface with an inner surface of a container neck the closure is affixed to. In a specific embodiment, the liner comprises an inner disc that extends between the rotational axis and the cylindrical portion. In a specific embodiment, the liner includes an outer disc that extends radially away from the cylindrical portion with respect to the rotational axis, and the outer disc includes a lower surfaces that faces away from the top panel.

Another embodiment of the invention relates to a closure including a top panel including a lower surface, a rotational axis about which the top panel is centered, a cylindrical wall extending from the lower surface of the top panel to a bottom edge of the cylindrical wall, a thread formed about an inner surface of the cylindrical wall, and a liner coupled to the lower surface of the top panel. The liner includes a lower surface facing away from the top panel, a recess and an outer-most surface. The recess extends a first distance from the lower surface of the top panel and the outer-most surface extends a second distance from the lower surface of the top panel greater than the first distance.

In a specific embodiment, the lower surface of the liner is configured to interface with an upper surface of a container neck the closure is affixed to. In a specific embodiment, the liner includes a cylindrical portion that extends away from the top panel and an outer disc that extends radially away from the cylindrical portion with respect to the rotational axis. The outer disc includes the lower surface that includes the recess.

Another embodiment of the invention relates to a closure including a top panel including a lower surface facing away from the upper surface, a rotational axis about which the top panel is centered, a cylindrical wall extending from the lower surface of the top panel to a bottom edge of the cylindrical wall, a thread formed about an inner surface of the cylindrical wall, and a cylindrical portion extending circumferentially around the rotational axis. The cylindrical portion includes an outer surface facing away from the rotational axis. The outer surface includes a first recess and an outer-most surface. The first recess extends a first distance from the rotational axis and the outer-most surface extends a second distance from the rotational axis greater than the first distance. An interfacing portion of the lower surface is radially further from the rotational axis than the cylindrical portion. The interfacing portion includes a second recess extending a third distance from the upper surface of the top panel. An outer-most surface of the interfacing portion extends a fourth distance from the upper surface of the top panel greater than the third distance.

Additional features and advantages will be set forth in the detailed description which follows, and, in part, will be readily apparent to those skilled in the art from the description or recognized by practicing the embodiments as described in the written description included, as well as the appended drawings. It is to be understood that both the foregoing general description and the following detailed description are exemplary.

The accompanying drawings are included to provide further understanding and are incorporated in and constitute a part of this specification. The drawings illustrate one or more embodiments and, together with the description, serve to explain principles and operation of the various embodiments.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
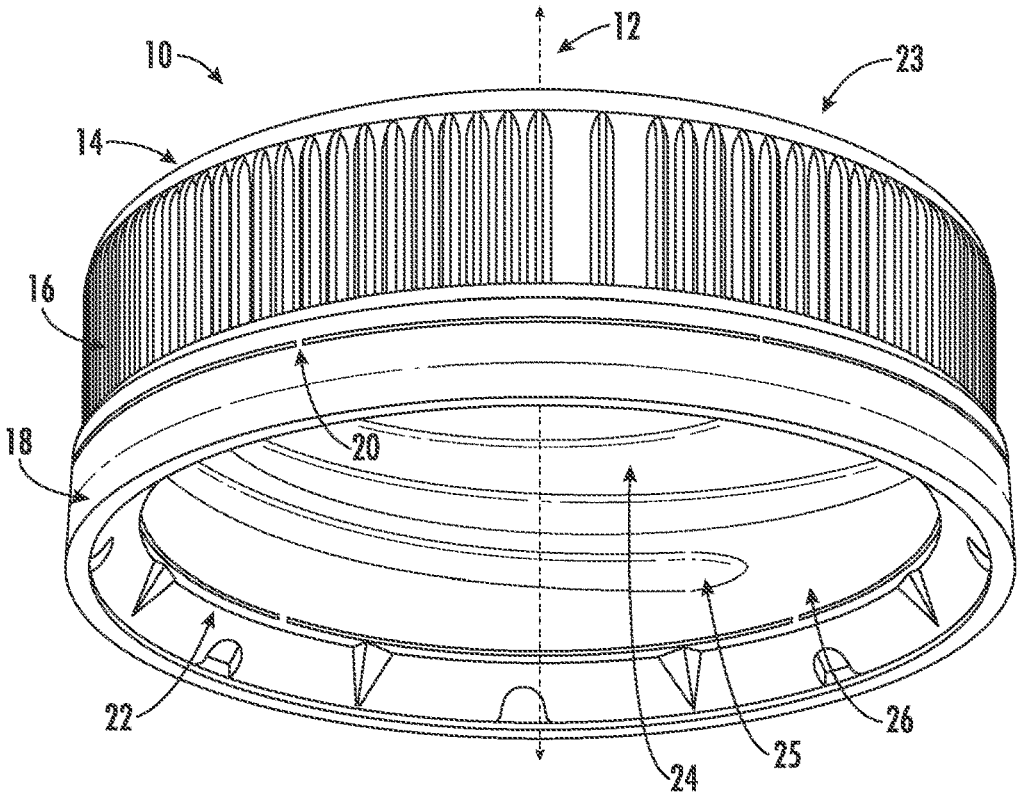
FIG. 1 is a perspective view of a closure, according to an exemplary embodiment.
Figure 2:
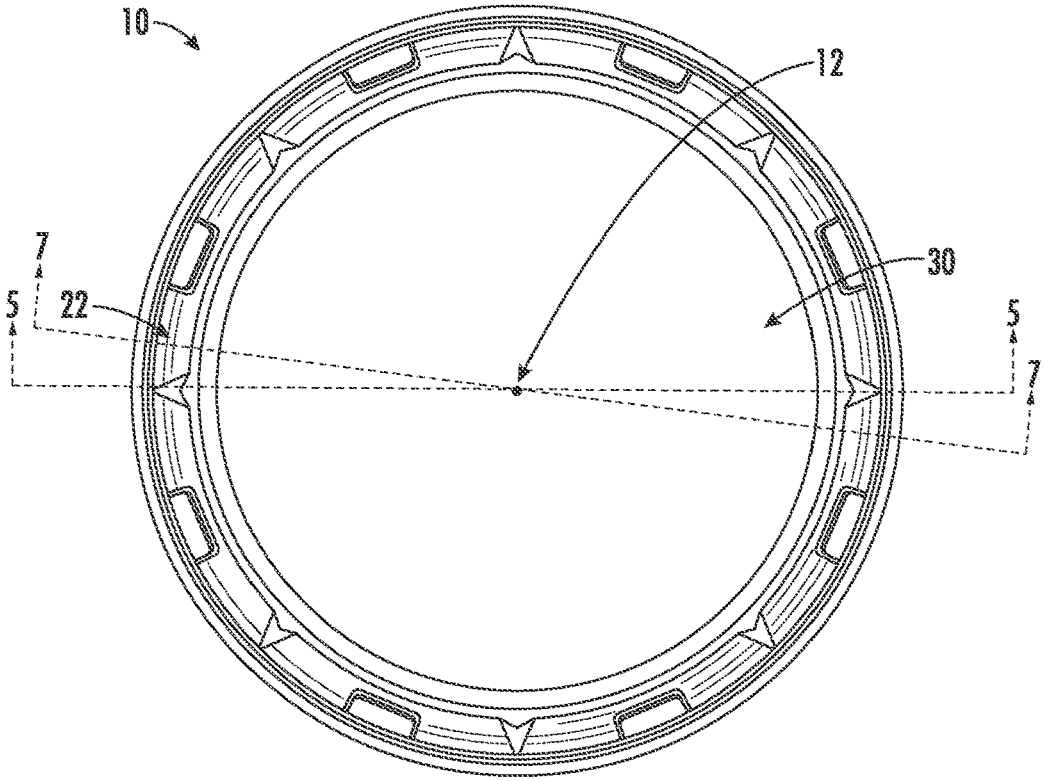
FIG. 2 is a bottom view of the closure of FIG. 1, according to an exemplary embodiment.

This disclosure provides a description for various embodiments of closures with a pressure-relieving structure. Applicant has observed that different embodiments of closures can have a high variance for how much pressure is required to break the seal between the closure and the container. In one or more embodiments, the closure includes one or more recesses that interface against the container neck the closure is affixed to. The recesses facilitate a reduced and more consistent pressure required to relieve pressure within the container compared to closures without a recess. In various embodiments the recesses are included in a liner affixed to a lower surface of the top panel of the closure.

Referring first to FIGS. 1-7, various aspects of a closure for a container, shown as closure 10, are shown. Closure 10 includes top panel 14. Top panel 14 is centered around rotational axis 12 of closure 10. A cylindrical wall, shown as skirt 16, extends downwardly from lower surface 24 of top panel 14. A thread 25 is formed about an inner surface 26 of the skirt 16. A tamper-evident band, shown as tamper band 18, is coupled to skirt 16 by one or more frangible connections 20. An interfacing portion, shown as J-band 22, is configured to interface with a container neck when closure 10 is being opened for the first time, thereby breaking frangible connections 20.

Figure 3:
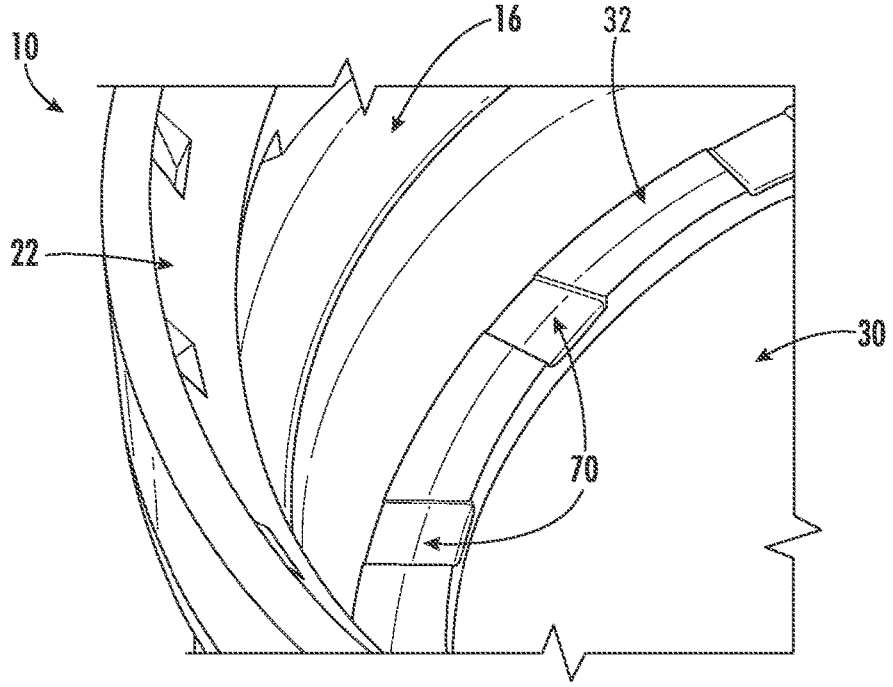
FIG. 3 is a detailed perspective view of a portion of the storage device of FIG. 1, according to an exemplary embodiment.
Figure 4:
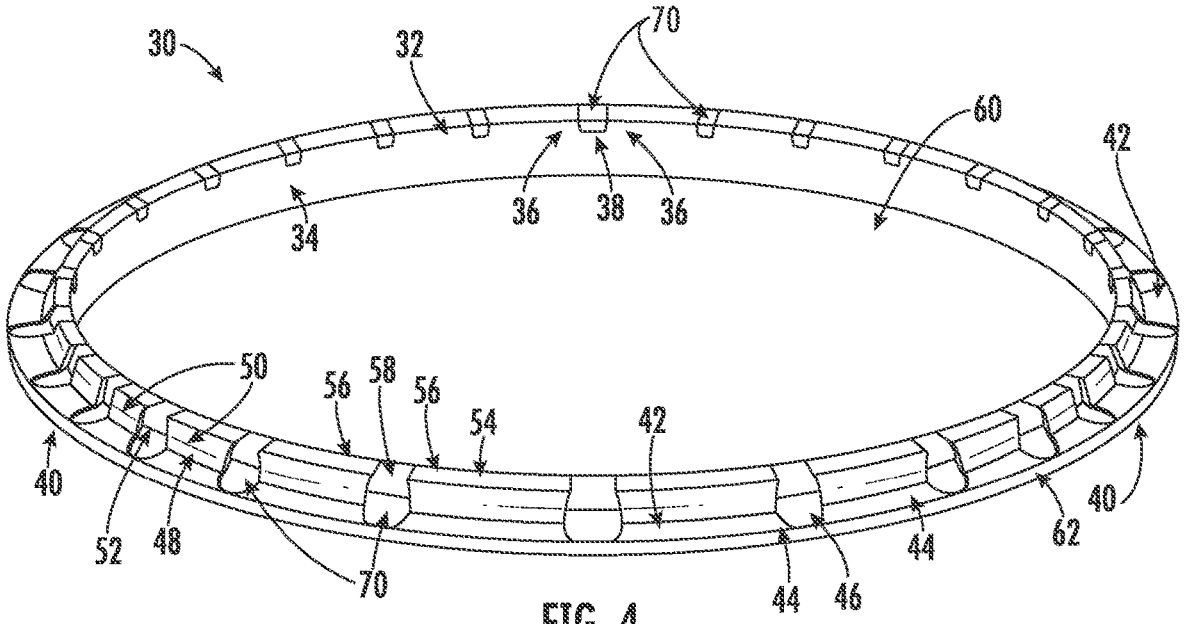
FIG. 4 is a perspective view of a liner of the closure of FIG. 1, according to an exemplary embodiment.

Referring to FIGS. 3-4, an interfacing panel, shown as liner 30, is coupled to lower surface 24 of top panel 14. As will be explained, one or more recesses 70 in liner 30 provide a pressure relieving functionality that reduces the maximum pressure retention and provides a smaller variance for the maximum pressure retention. In various embodiments, liner 30 includes a cylindrical wall 32 extending away from top panel 14, an inner disc 60 that extends between the rotational axis 12 and the cylindrical wall 32, and/or an outer disc 40 that extends radially away from the cylindrical wall 32 with respect to the rotational axis 12.

In a specific embodiment, recesses 70 are arranged symmetrically around liner 30 with respect to rotational axis 12. In various embodiments, recesses 70 are configured to relieve pressure from the chamber of a container that closure 10 is affixed to. In various embodiments, primary recesses 70 include recess 38, recess 46, recess 52, and recess 58. In particular, in various embodiments primary recesses 70 include recess 38 in inner surface 34 of cylindrical wall 32, recess 46 on lower surface 42 of outer disc 40, recess 52 of outer surface 48 of cylindrical wall 32, and recess 58 of lower surface 54 of cylindrical wall 32.

In various embodiments, one or more of recess 38, recess 46, recess 52, and recess 58 are in fluid communication with one or more of recess 38, recess 46, recess 52, and recess 58. In various embodiments, one or more of recess 46 and recess 58 extend radially away from axis 12.

The cylindrical wall 32 includes an outer surface 48 facing away from the rotational axis 12. The outer surface 48 includes a recess 52 and an extended portion 50.

The outer disc 40 includes a lower surface 42 that faces away from the top panel 14. The lower surface 42 includes a recess 46 configured to interface with an upper surface of a container neck the closure 10 is affixed to.

Referring to inner surface 34 of cylindrical wall 32 in particular, inner surface 34 includes one or more recesses 38 and one or more extended portions 36. Extended portions 36 extend further than recesses 38, thereby enabling recesses 38 to provide fluid communication between an interior chamber of a container and an exterior of the container.

Referring to lower surface 42 of outer disc 40 in particular, lower surface 42 includes one or more recesses 46 and one or more extended portions 44. Extended portions 44 extend further than recesses 46, thereby enabling recesses 46 to provide fluid communication between an interior chamber of a container and an exterior of the container. In various embodiments, lower surface 42 is configured to interface against an upper surface of a container neck of a container the closure is affixed to. In various embodiments, the container neck depresses the extended portions 44 to be coplanar or nearly coplanar with the recesses 46 when closure 10 is affixed to the container. However, even though recesses 46 are coplanar or nearly coplanar with extended portions 44, recesses 46 are still configured to provide relief from excess pressure within the container via the lower compressive force exerted between the container neck and the recesses 46 compared to the compressive force exerted between the container neck and the extended portions 44.

Referring to outer surface 48 of cylindrical wall 32 in particular, outer surface 48 includes one or more recesses 52 and one or more extended portions 50. Extended portions 50 extend further than recesses 52, thereby enabling recesses 52 to provide fluid communication between an interior chamber of a container and an exterior of the container. In various embodiments, outer surface 48 is configured to interface against an outer surface of a container neck of a container the closure is affixed to. In various embodiments, the container neck depresses the extended portions 50 to be coplanar or nearly coplanar with the recesses 52 when closure 10 is affixed to the container. However, even though recesses 52 are coplanar or nearly coplanar with extended portions 50, recesses 52 are still configured to provide relief from excess pressure within the container via the lower compressive force exerted between the container neck and the recesses 52 compared to the compressive force exerted between the container neck and the extended portions 50.

Referring to lower surface 54 of cylindrical wall 32 in particular, lower surface 54 includes one or more recesses 58 and one or more extended portions 56. Extended portions 56 extend further than recesses 58, thereby enabling recesses 58 to provide fluid communication between an interior chamber of a container and an exterior of the container.

Outer surface 62 of outer disc 40 faces away from rotational axis 12. In various embodiments, recesses 70 extend at least partially into outer surface 62.

In a specific embodiment, top panel 14 and skirt 16 are formed from a first material, such as a plastic shell, and liner 30 is formed from a second material different from the first material, such as a thermoplastic elastomer (TPE). In various embodiments liner 30 is formed from a material that is more compressible than a material that top panel 14 is formed from. For example, liner 30 has a lower durometer measurement than top panel 14.

Figure 5:
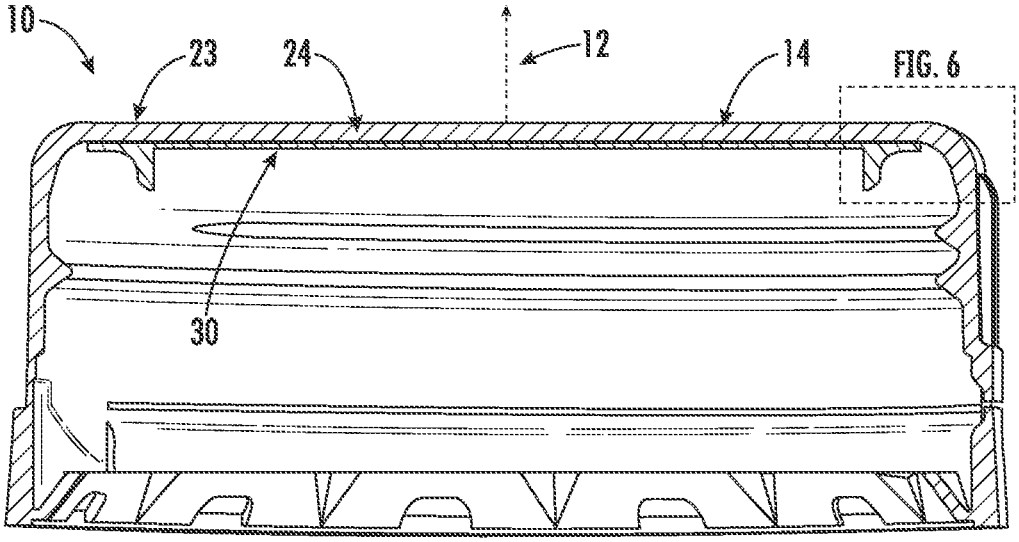
FIG. 5 is a cross-section view of the closure of FIG. 1 taken along the line 5-5 in FIG. 2, according to an exemplary embodiment.
Figure 6:
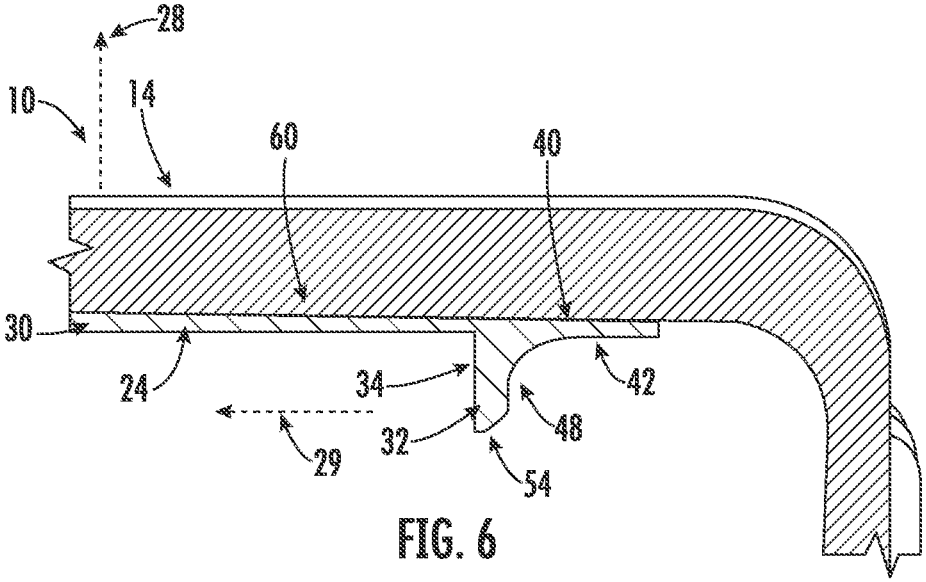
FIG. 6 is a detailed cross-section view of the closure of FIG. 5, according to an exemplary embodiment.

Referring to FIGS. 5-6, shown is a cross-section of closure 10 in which recesses 70 are not shown in FIG. 6. In particular, depicted in liner 30 in FIG. 6 are extended portion 36, extended portion 44, extended portion 50, and extended portion 56. Top panel 14 includes an upper surface 23 and an opposing lower surface 24.

In various embodiments, when closure 10 is coupled to a container, top panel 14 is configured to deflect upward in direction 28 in response to an increased pressure within the container that closure 10 is affixed to. Further, in response to the top panel 14 deflecting upward in direction 28, the cylindrical wall 32 is configured to deflect inward in direction 29 towards the rotational axis 12. Further, in various embodiments one or more of recess 38, recess 46, recess 52, and recess 58 are configured to relieve pressure from the container in response to the cylindrical wall 32 deflecting inward.

Figure 7:
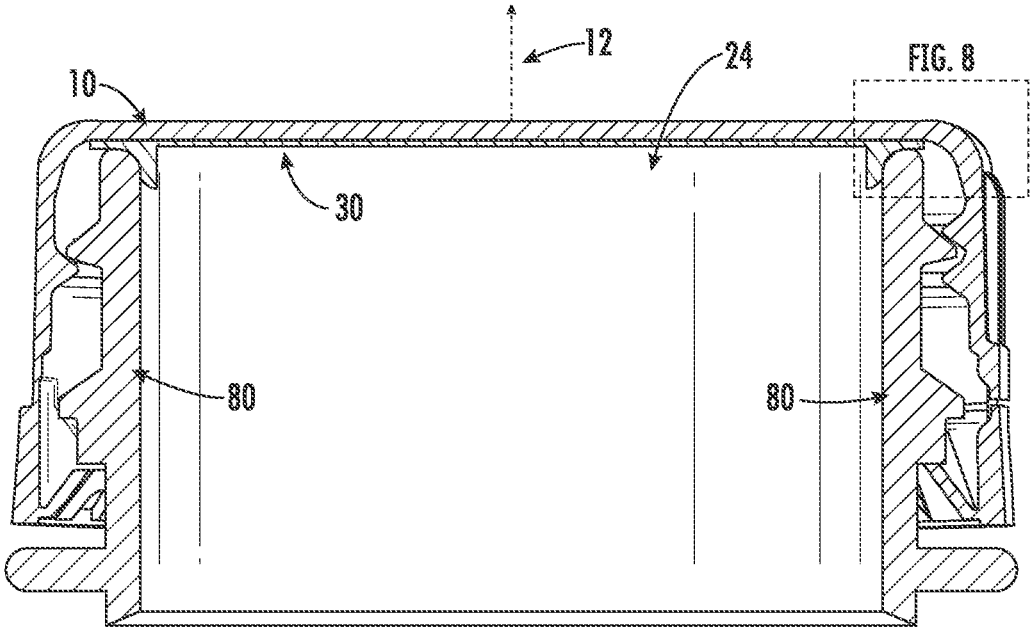
FIG. 7 is a cross-section view of the closure of FIG. 1 taken along the line 7-7 in FIG. 2, shown affixed to a container, according to an exemplary embodiment.
Figure 8:
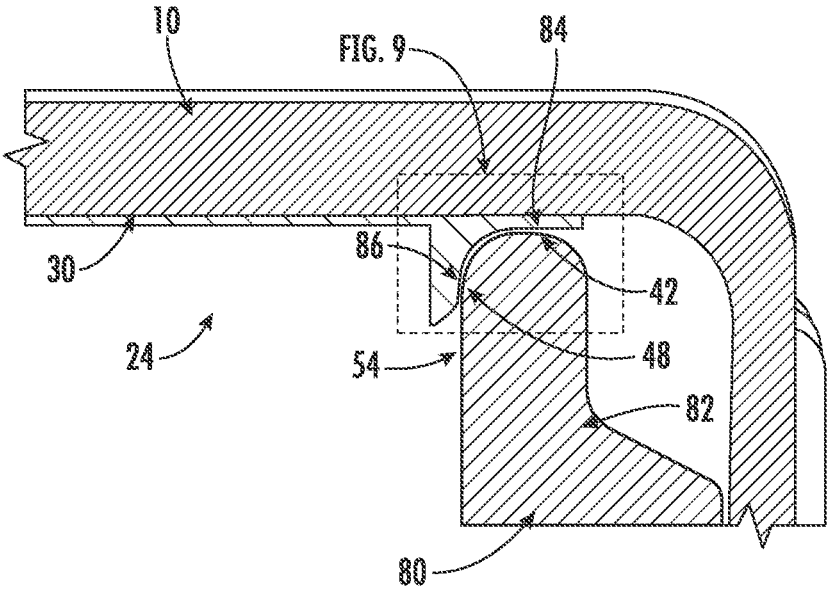
FIG. 8 is a detailed cross-section view of the closure of FIG. 7, according to an exemplary embodiment.
Figure 9:
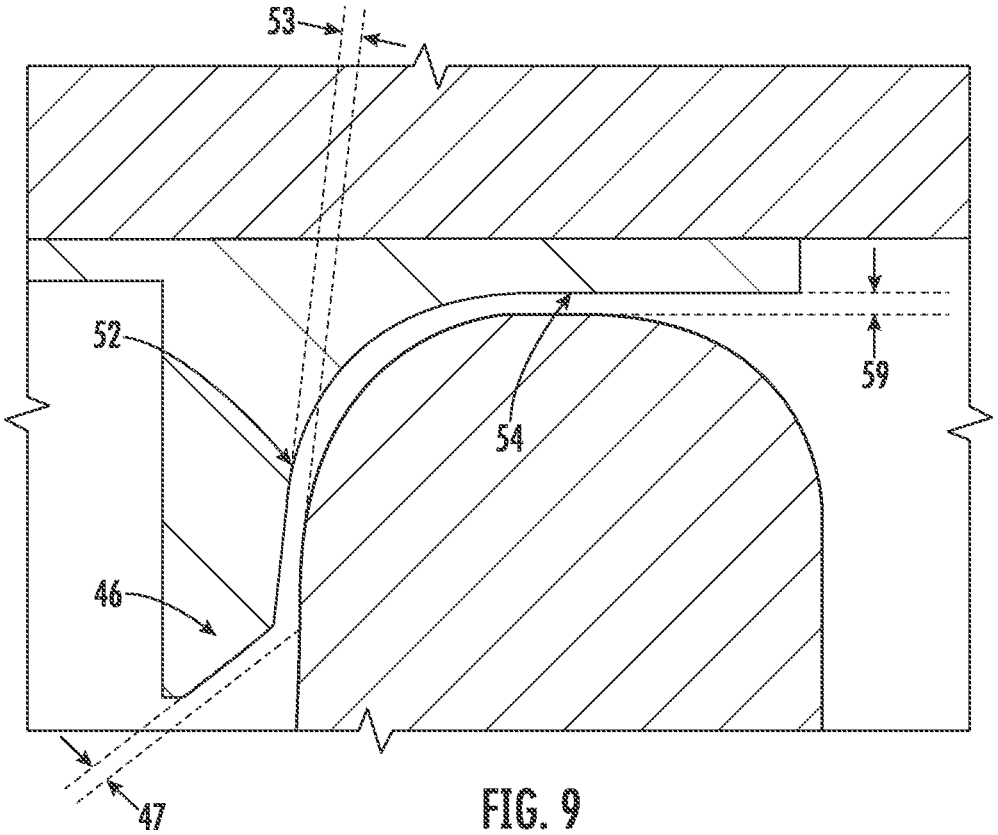
FIG. 9 is a detailed cross-section view of the closure of FIG. 7, according to an exemplary embodiment.

Referring to FIGS. 7-9, shown is a cross-section of closure 10 in which recesses 70 are shown in FIGS. 8-9. FIGS. 7-9 show the interface of recesses 70 and container neck 82. In particular, FIGS. 7-9 show the configuration of liner 30 and container neck 82 when the recesses 70 are venting pressure from the container. It will be understood that when recesses 70 are not venting pressure, liner 30 is compressed such that one or more portions of recesses 70 are interfacing against container neck 82, thereby sealing the contents of container 80 within container 80.

In use closure 10 is affixed to container neck 82 of container 80. Container neck 82 includes an upper surface 84, facing upwards when container 80 is in an upright orientation, and an inner surface 86, which faces inwards towards rotational axis 12 of closure 10 when closure 10 is affixed to container neck 82. Interior chamber 24 is encapsulated by closure 10 and container 80.

Liner 30 includes cylindrical wall 32, which extends away from top panel 14, such as downwards away from top panel 14. Inner surface 34 of cylindrical wall 32 faces towards rotational axis 12, and opposing outer surface 48 of cylindrical wall 32 faces away from rotational axis 12. Outer disc 40 extends radially outward from cylindrical wall 32 with respect to rotational axis 12. Inner disc 60 extends radially inward from cylindrical wall 32 with respect to rotational axis 12. Lower surface 54 of cylindrical wall 32 faces away from top panel 14. In a specific embodiment, recesses 70 extend from lower surface 42 of outer disc 40 through outer surface 48 of cylindrical wall 32.

Referring to FIG. 8, when closure 10 is affixed to container neck 82, upper surface 84 of container neck 82 interfaces against lower surface 42 of outer disc 40 of liner 30. Inner surface 86 of container neck 82 interfaces against outer surface 48 of cylindrical wall 32. As pressure builds within interior chamber 24, recesses 70 provide a reduced amount of pressure necessary to breach the interface between closure 10 (specifically liner 30) and container neck 82. As a result, pressure within interior chamber 24 has a lower limit compared to the pressure buildup for closures 10 without recesses 70.

In addition to recesses 70 reducing the pressure required to break the seal between closure 10 and container 80, recesses 70 also lower the variance of the pressure required to break the seal between closure 10 and container 80. Reducing the variance provides manufacturers of closures 10 and/or containers 80 to provide a more stable platform to present their product to the public.

Referring to FIGS. 8-9, recess 46 extends distance 47 less far than extended portions 44, which are on either side of recess 46. Stated another way, the extended portion 44 of lower surface 42 of outer disc 40 extends a distance 47 from the upper surface 23 of the top panel 14 further than the recess 46.

Recess 52 extends distance 53 less than extended portions 50, which are on either side of recess 52. Stated another way, the extended portion 50 of outer surface 48 of cylindrical wall 32 extends a distance 53 further from the rotational axis 12 than the first recess 52.

Recess 58 extends distance 59 less than extended portions 56, which are on either side of recess 58 (see FIG. 4). Stated another way, the extended portion 56 of lower surface 54 of cylindrical wall 32 extends a distance 59 further than recess 58 from top panel 14, such as from the lower surface 24 and/or upper surface 23 of top panel 14.

It should be understood that the figures illustrate the exemplary embodiments in detail, and it should be understood that the present application is not limited to the details or methodology set forth in the description or illustrated in the figures. It should also be understood that the terminology is for description purposes only and should not be regarded as limiting.

Further modifications and alternative embodiments of various aspects of the disclosure will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that any particular order be inferred. In addition, as used herein, the article "a" is intended to include one or more component or element, and is not intended to be construed as meaning only one. As used herein, "rigidly coupled" refers to two components being coupled in a manner such that the components move together in a fixed positional relationship when acted upon by a force.

Various embodiments of the disclosure relate to any combination of any of the features, and any such combination of features may be claimed in this or future applications. Any of the features, elements or components of any of the exemplary embodiments discussed above may be utilized alone or in combination with any of the features, elements or components of any of the other embodiments discussed above.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A closure comprising:

a top panel including an upper surface and a lower surface;

a rotational axis about which the top panel is centered;

a skirt extending from the lower surface of the top panel;

a thread formed about an inner surface of the skirt; and a liner coupled to the lower surface of the top panel, the liner, for a neck of a container, comprising a cylindrical wall extending away from the top panel, the cylindrical wall comprising an outer surface facing away from the rotational axis, the outer surface comprising a first recess and a first extended portion, the first extended portion extending a first distance further from the rotational axis than the first recess, the liner sealing interfacing with the container neck of the container, the first recess providing a pressure relieving functionality between the liner and the neck of the container that reduces the maximum pressure retention between the closure and the container.

2. The closure of claim 1, wherein the outer surface is configured to interface with an inner surface of the container neck the closure is affixed to.

3. The closure of claim 1, the liner comprising an inner disc that extends between the rotational axis and the cylindrical wall.

4. The closure of claim 1, the liner comprising an outer disc that extends radially away from the cylindrical wall with respect to the rotational axis, the outer disc comprising a lower surface that faces away from the top panel, the lower surface comprising a second recess configured to interface with an upper surface of the container neck the closure is affixed to.

5. The closure of claim 4, the lower surface of the outer disc comprising a second extended portion, the second extended portion extending a second distance from the upper surface of the top panel further than the second recess.

6. The closure of claim 4, wherein the first recess and the second recess are in fluid communication.

7. The closure of claim 1, wherein the closure is coupled to the container, and in response to the top panel deflecting upward the cylindrical wall is configured to deflect inward towards the rotational axis, and wherein the first recess is configured to relieve pressure from the container in response to the cylindrical wall deflecting inward.

8. The closure of claim 1, wherein the cylindrical wall defines a lower surface that faces away from the top panel, wherein the lower surface of the cylindrical wall defines a second recess in fluid communication with the first recess.

9. The closure of claim 1, wherein the top panel is formed from a first material, and the liner is formed from a second material different than the first material, and second material is more compressible than the first material.

10. A closure comprising:

a top panel including an upper surface and a lower surface;

a rotational axis about which the top panel is centered;

a skirt extending from the lower surface of the top panel;

a thread formed about an inner surface of the skirt; and a liner coupled to the lower surface of the top panel, the liner, for a neck of a container, comprising a lower surface facing away from the top panel, the lower surface comprising a first recess and a first extended portion, the first extended portion extending a first distance from the lower surface of the top panel further than the first recess, the liner sealing interfacing with the container neck of the container, the first recess providing a pressure relieving functionality between the liner and the neck of the container that reduces the maximum pressure retention between the closure and the container.

11. The closure of claim 10, wherein the lower surface of the liner is configured to interface with an upper surface of the container neck the closure is affixed to.

12. The closure of claim 10, the liner comprising a cylindrical wall that extends downward away from the top panel and an outer disc that extends radially away from the cylindrical wall with respect to the rotational axis, wherein the outer disc comprises the lower surface.

13. The closure of claim 12, the liner comprising an inner disc that extends between the rotational axis and the cylindrical wall.

14. The closure of claim 12, wherein the closure is coupled to the container, and in response to the top panel deflecting upward the cylindrical wall is configured to deflect inward towards the rotational axis, and wherein the first recess is configured to relieve pressure from the container in response to the cylindrical wall deflecting inward.

15. The closure of claim 12, the cylindrical wall comprising an outer surface facing away from the rotational axis, the outer surface comprising a second recess and a second extended portion, the second extended portion extending a second distance further from the rotational axis than the second recess.

16. The closure of claim 15, wherein the cylindrical wall defines a lower surface that faces away from the top panel, wherein the lower surface of the cylindrical wall defines a third recess in fluid communication with the second recess.

17. The closure of claim 10, wherein the top panel is formed from a first material, and the liner is formed from a second material different than the first material, and second material is more compressible than the first material.

18. A closure comprising:

a top panel including an upper surface and a lower surface, the top panel formed from a first material;

a rotational axis about which the top panel is centered;

a skirt extending from the lower surface of the top panel;

a thread formed about an inner surface of the skirt; and a liner coupled to the lower surface of the top panel, the liner configured to sealing engage against a neck of a container thereby sealing contents within a chamber of the container, the liner being formed from a second material that is more compressible than the first material, the liner comprising a first recess and a neighboring first extended portion, each of which interface against the container neck, wherein the first recess is configured to relieve pressure from the chamber, the liner sealing interfacing with the neck of the container, and the first recess providing a pressure relieving functionality between the liner and the neck of the container that reduces the maximum pressure retention between the closure and the container.

19. The closure of claim 18, the liner comprising a cylindrical wall that extends downward away from the top panel, the liner further comprising an inner disc that extends between the rotational axis and the cylindrical wall.

20. The closure of claim 19, wherein in response to the top panel deflecting upward the cylindrical wall is configured to deflect inward towards the rotational axis, and wherein the first recess is configured to relieve pressure from the container in response to the cylindrical wall deflecting inward.

* * * * *